US011608684B2

(12) United States Patent
Kanchi et al.

(10) Patent No.: US 11,608,684 B2
(45) Date of Patent: Mar. 21, 2023

(54) MAST FOR DRILLING MACHINES

(71) Applicant: Caterpillar Global Mining Equipment LLC, Denison, TX (US)

(72) Inventors: Sravana K. Kanchi, Aurora, IL (US); Andrew C. Barber, Oswego, IL (US); Rafal T. Myslak, Frisco, TX (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 205 days.

(21) Appl. No.: 16/950,154

(22) Filed: Nov. 17, 2020

(65) Prior Publication Data

US 2022/0154533 A1 May 19, 2022

(51) Int. Cl.
*E21B 7/02* (2006.01)
*E21B 15/00* (2006.01)

(52) U.S. Cl.
CPC ..... *E21B 7/023* (2013.01); *E21B 15/00* (2013.01)

(58) Field of Classification Search
CPC ..... E04H 12/34; E04H 12/10; E04H 12/00; E04H 12/08; E21B 7/023; E21B 15/00
See application file for complete search history.

(56) References Cited

U.S. PATENT DOCUMENTS

| | | | | |
|---|---|---|---|---|
| 2,617,500 | A | 11/1952 | Cardwell | |
| 3,245,180 | A * | 4/1966 | Bules | E21B 7/02 52/143 |
| 4,003,168 | A * | 1/1977 | Brady | B66C 23/701 52/843 |
| 5,927,440 | A * | 7/1999 | Freeman | B66B 9/16 187/270 |
| 8,235,126 | B2 | 8/2012 | Bradley | |
| 8,671,626 | B1 * | 3/2014 | Marty | E21B 15/00 414/22.55 |
| 9,540,908 | B1 | 1/2017 | Olivier | |
| 9,970,241 | B2 | 5/2018 | Ledet | |

* cited by examiner

*Primary Examiner* — Gregory W Adams

(57) ABSTRACT

A mast for a drilling machine is disclosed. The mast includes a frame assembly defining an inner volume to accommodate a drilling assembly of the drilling machine. The frame assembly includes a first beam, a second beam, a plurality of links, a plurality of reinforcement members, and a plate, that combinedly form a truss. The plate defines an opening to facilitate access to the inner volume of the frame assembly.

18 Claims, 4 Drawing Sheets

MAST FOR DRILLING MACHINES

TECHNICAL FIELD

The present disclosure relates generally to masts for drilling machines. More particularly, the present disclosure relates to a mast that defines an opening to allow operator ingress and egress to and from an inner volume of the mast from a lateral side of the mast.

BACKGROUND

Drilling machines are used to drill into ground surfaces in applications, such as mining. In one example, a drilling machine may be used to drill holes into a ground surface to access minerals, liquids, or gases, or to place explosives in preparation for blasting. Such drilling machines may include a chassis which may support a drill tower (commonly known as a "mast"). The mast commonly defines an inner volume where a number of systems and/or sub-systems associated with the drilling machine may be housed. As an example, the mast may house a plurality of drilling components, such as a drill carousel, multiple pipe segments (e.g., drill pipes, drill rods, drill extenders, etc.), a drill string formed from a combination of pipe segments, a rotary drill head, a drill bit (e.g., rotary or hammer style) and the like, that may be applied to drill the holes into the ground surface.

Such systems and/or sub-systems may require regular servicing and maintenance. In some cases, a service and maintenance activity of such systems and/or sub-systems may be carried out frequently—e.g., daily, weekly, or monthly, as otherwise, such systems and/or sub-systems may undergo cyclic fatigue and stress. Accessing the inner volume of the mast for servicing such systems and/or sub-systems, however, is a tedious and time-consuming affair, affecting machine downtime and productivity.

SUMMARY OF THE INVENTION

In an aspect of the present disclosure, a mast for a drilling machine is disclosed. The mast includes a frame assembly defining an inner volume to accommodate a drilling assembly of the drilling machine. The frame assembly is configured to move between a lowered position and a raised position with respect to a chassis of the drilling machine. The frame assembly includes a first beam and a second beam. Both the first beam and the second beam are configured to be directed towards a lateral side of the drilling machine when the frame assembly is at the lowered position. The frame assembly further includes a plurality of links sequentially arranged between the first beam and the second beam, thereby coupling the first beam to the second beam. Also, the frame assembly includes a plurality of reinforcement members correspondingly disposed and spanning between successive links of the plurality of links, with at least one pair of successive links of the plurality of links being devoid of a reinforcement member of the plurality of reinforcement members. The frame assembly also includes a plate disposed between the successive links of the at least one pair of successive links. The plate is coupled to each link of the at least one pair of successive links and to the first beam and the second beam. The plate defines an opening to facilitate access to the inner volume of the frame assembly. The first beam, the second beam, the plurality of links, the plurality of reinforcement members, and the plate, combinedly form a truss.

In another aspect, the present disclosure is directed to a drilling machine. The machine includes a chassis, a drilling assembly, and a mast. The mast includes a frame assembly that defines an inner volume to accommodate the drilling assembly. The frame assembly is configured to move between a lowered position and a raised position with respect to the chassis. The frame assembly includes a first beam and a second beam. Both the first beam and the second beam are configured to be directed towards a lateral side of the drilling machine when the frame assembly is at the lowered position. The frame assembly further includes a plurality of links sequentially arranged between the first beam and the second beam, thereby coupling the first beam to the second beam. Also, the frame assembly includes a plurality of reinforcement members correspondingly disposed and spanning between successive links of the plurality of links, with at least one pair of successive links of the plurality of links being devoid of a reinforcement member of the plurality of reinforcement members. The frame assembly also includes a plate disposed between the successive links of the at least one pair of successive links. The plate is coupled to each link of the at least one pair of successive links and to the first beam and the second beam. The plate defines an opening to facilitate access to the inner volume of the frame assembly. The first beam, the second beam, the plurality of links, the plurality of reinforcement members, and the plate, combinedly form a truss.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

Figure 1:
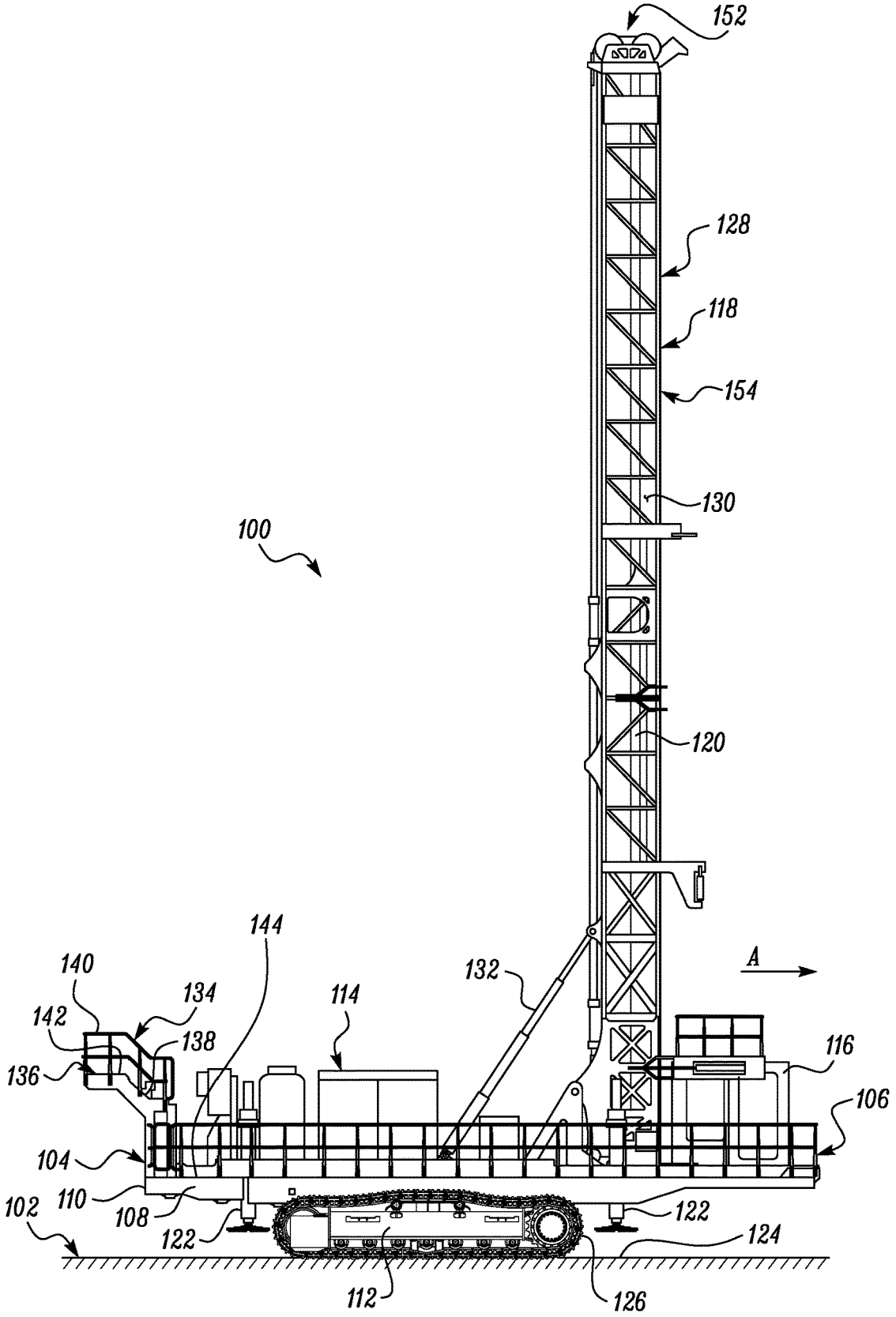
FIG. 1 is a side view of a drilling machine having a mast in a raised or a vertical position, in accordance with an embodiment of the present disclosure.
Figure 2:
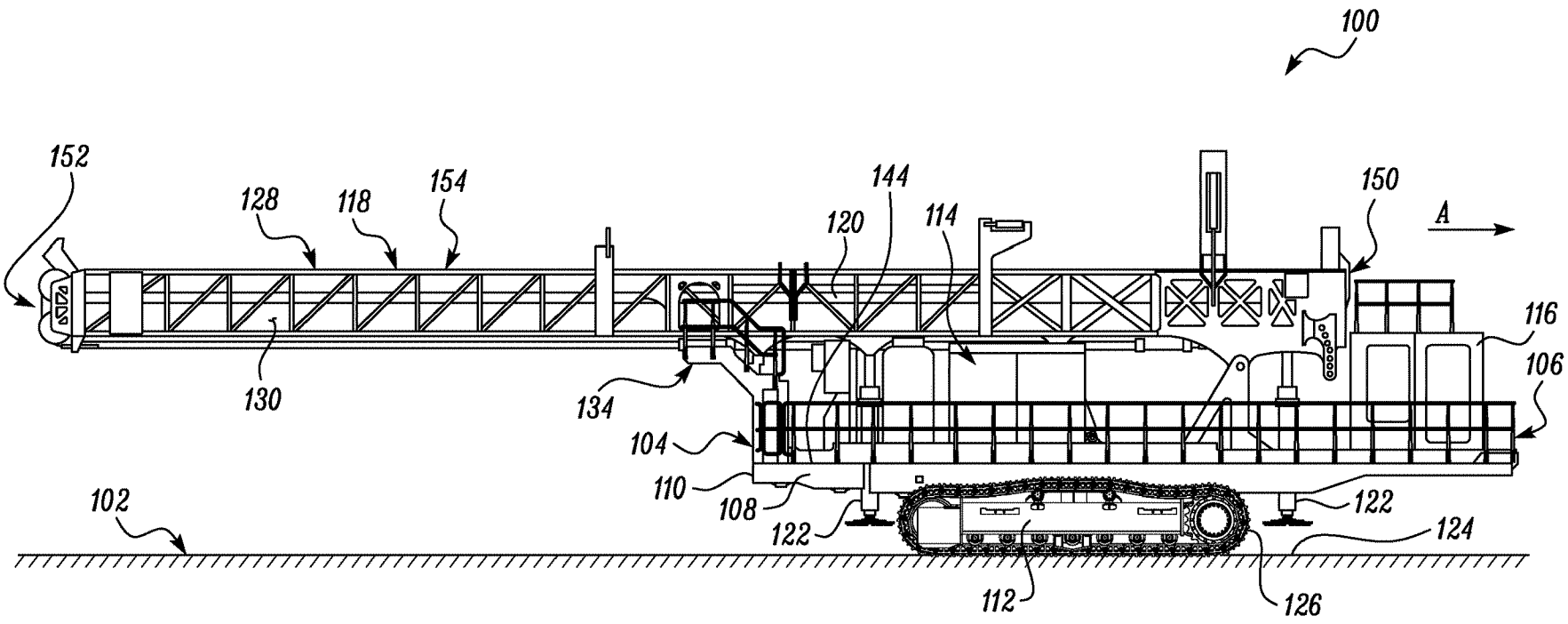
FIG. 2 is a side view of the drilling machine having the mast in a lowered or a stowed position, in accordance with an embodiment of the present disclosure.
Figure 3:
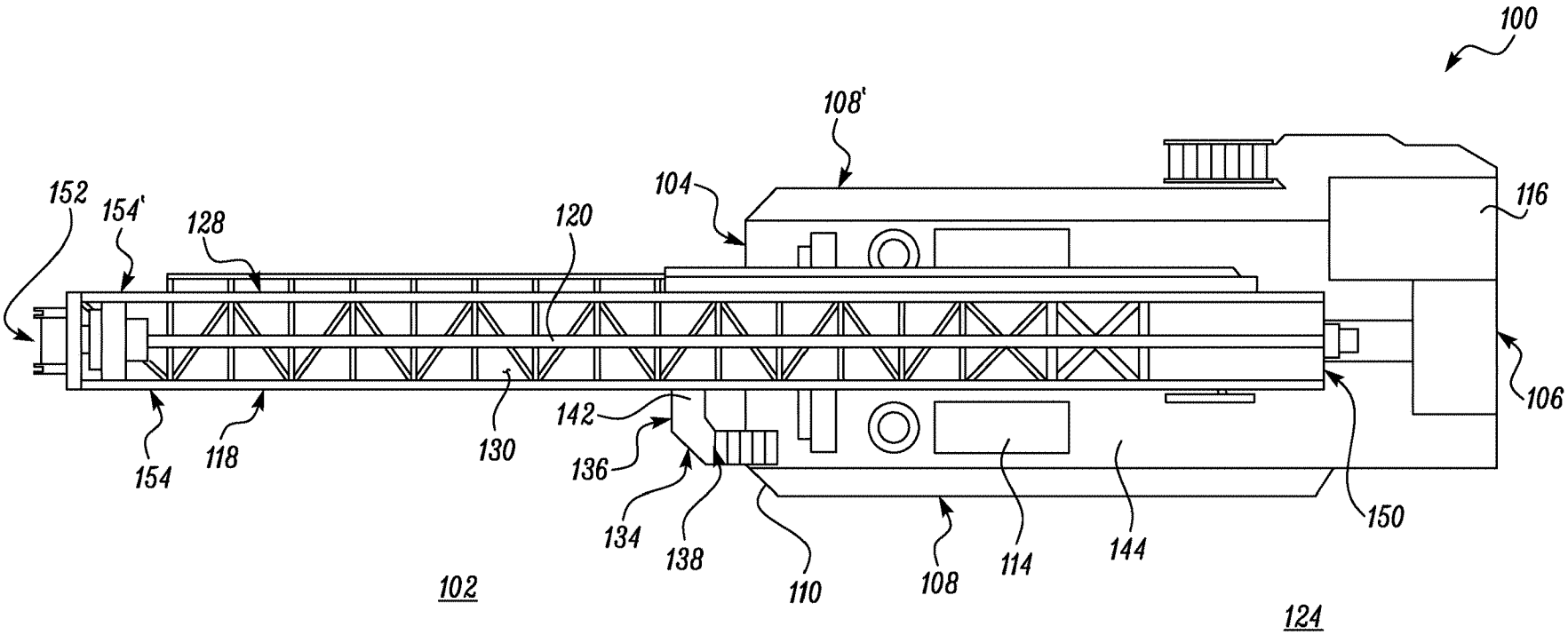
FIG. 3 is a top view of the drilling machine having the mast in the lowered or the stowed position, in accordance with an embodiment of the present disclosure.

Referring to FIGS. 1, 2, and 3, a drilling machine 100 (hereinafter referred to as a machine 100, for ease in reference) is illustrated. The machine 100 may be used in a variety of applications including mining, quarrying, road construction, construction site preparation, etc. For example, the machine 100 of the present disclosure may be employed for penetrating into earth to mine for materials, such as ore, soil, debris, or other naturally occurring deposits at a jobsite 102. The machine 100 may include one of a blast-hole drilling machine, a rotary drilling machine, a surface drilling machine, or any other drilling machine known in the art.

The machine 100 may include a forward end 104 and a rearward end 106 opposite to the forward end 104. The forward end 104 and the rearward end 106 may be defined in relation to an exemplary direction of travel (indicated by an arrow 'A') of the machine 100, with said direction of travel being defined from the forward end 104 towards the rearward end 106. Also, the machine 100 may include two lateral sides, i.e., a first lateral side (or left side) 108 and a second lateral side (or right side) 108' opposite to the first lateral side 108. The two lateral sides may be located transversely relative to the exemplary direction of travel 'A' of the machine 100.

The machine 100 includes a chassis 110, ground-engaging traction assemblies 112, a propulsion system 114, an operator cabin 116, a mast 118, and a drilling assembly 120. The chassis 110 may extend from the forward end 104 to the rearward end 106 of the machine 100. The chassis 110 may accommodate the propulsion system 114, the operator cabin 116, the mast 118, and the drilling assembly 120, although other known components and structures may be supported by the chassis 110, as well. Also, the chassis 110 may include one or more jack units 122. The one or more jack units 122 may be configured to extend generally downwardly, relative to the machine 100, and be pushed against an underlying ground 124 (or the jobsite 102) to stabilize and level the machine 100 during the drilling operations. In the present disclosure, four jack units 122 are provided (two of which are located towards the first lateral side 108 and thus illustrated, see FIGS. 1 and 2).

The chassis 110 may be supported on the ground 124 by the ground-engaging traction assemblies 112. The ground-engaging traction assemblies 112 may include a set of crawler tracks 126. The crawler tracks 126 may be configured to move and transport the machine 100 from one location to another, according to a customary practice known in the art. In the present embodiment, two crawler tracks 126 are provided, one on each side of the machine 100 (only one crawler track 126 is visible in FIGS. 1 and 2). In some embodiments, the ground-engaging traction assemblies 112 may include wheeled units (not shown) provided either alone or in combination with the crawler tracks 126.

The ground-engaging traction assemblies 112 may be powered by the propulsion system 114 to operate, and to propel the machine 100 along the ground 124. The propulsion system 114 may include an engine (not shown), such as an internal combustion engine, configured to power operations of various systems on the machine 100, typically by combusting fuel. Optionally, the propulsion system 114 may also include an electrical power source, applicable either alone or in combination with the internal combustion engine.

The operator cabin 116 may be supported over the chassis 110. The operator cabin 116 may facilitate stationing of one or more operators therein, to monitor the operations of the machine 100. Also, the operator cabin 116 may house various components and controls of the machine 100, such as joysticks, display units, etc. (not shown), that may be used for facilitating the machine's movement and operation at the jobsite 102. In the present embodiment, the operator cabin 116 is located proximal to the rearward end 106 of the machine 100 and distal to the forward end 104 of the machine 100 (see FIG. 3). In some embodiments, the machine 100 may be operated autonomously or semi-autonomously. In such a case, the operator cabin 116 may be located remotely from the machine 100.

Referring to FIGS. 1, 2, and 3, the mast 118 includes a frame assembly 128. The frame assembly 128 may be formed from beams, links, reinforcement members, etc., connected together to define an inner volume 130 of the mast 118 (each of which will be discussed in detail below with reference to FIG. 4). However, in some embodiments, it is contemplated that the mast 118 may be formed from multiple sections of sheet metal or gusset plates that may be joined together to fabricate a single frame (defining an inner volume) of the mast 118. Further, the frame assembly 128 may be coupled and mounted to the chassis 110. As an example, the frame assembly 128 may be pivotably coupled to the chassis 110 to move between a raised position (see FIG. 1) and a lowered position (see FIG. 2) with respect to the chassis 110. For example, the raised position of the mast 118 may be a vertical position of the mast 118 with respect to the ground 124 and at which the machine 100 may perform the drilling operation. Also, the lowered position of the mast 118 may be a horizontal or stowed position of the mast 118 at which the mast 118 may be stowed on the machine 100 to facilitate the machine 100 to tram across the jobsite 102. In another example, the raised position of the mast 118 may be a position at which the mast 118 may be at an angle with respect to the chassis 110 and at which the drilling assembly 120 may perform the drilling operation to drill holes at an angle. In such an exemplary case, the angle may range up to 30 degrees from the vertical position (at which the top of the mast 118 may be tilted towards the forward end 104 of the machine 100 and a drill bit of the drilling assembly 120 may be pointing towards the rearward end 106 of the machine 100). In the present embodiment, the frame assembly 128 may move between the lowered position and the raised position by way of one or more actuators 132. The actuators 132 may be selected from at least one of hydraulically powered cylinders, or pneumatically powered cylinders, or the like.

The mast 118 may house and support the drilling assembly 120. For example, the drilling assembly 120 may be accommodated within the inner volume 130 of the frame assembly 128 of the mast 118. The drilling assembly 120 may be configured to drill and/or penetrate into the ground 124. The drilling assembly 120 may include several drilling components, such as a drill carousel, pipe segments (e.g., drill pipes, drill rods, drill extenders, etc.), a drill string formed from a combination of pipe segments, a drill head, a drill bit, and the like. Such drilling components and their functionality are known in the art, and therefore, they are not discussed, for the sake of brevity.

The machine 100 may further include a mast access assembly 134. The mast access assembly 134 may be located towards the forward end 104 of the machine 100. The mast access assembly 134 may include a platform 136, a stairway 138, and a handrail 140. The platform 136 may define a surface 142 on which an operator (or service personnel) may be stationed, at any given point, for access into the mast 118. The surface 142 may include a treaded portion (not shown) to provide traction to the operator walking on the surface 142. The platform 136 may be connected to the stairway 138 to allow an operator to reach up to the platform from an upper deck 144 of the machine 100. The stairway 138 may include steps (not shown) that may lead an operator all the way up to the platform 136 (as shown, the surface 142 of the platform 136 is disposed above the upper deck 144). The handrail 140 may be coupled to the platform 136 and the stairway 138 to which the operator (or service personnel) may hold onto (to maintain three-points of contact for support and stability) while climbing or moving up to the platform 136 by using the stairway 138.

Figure 4:
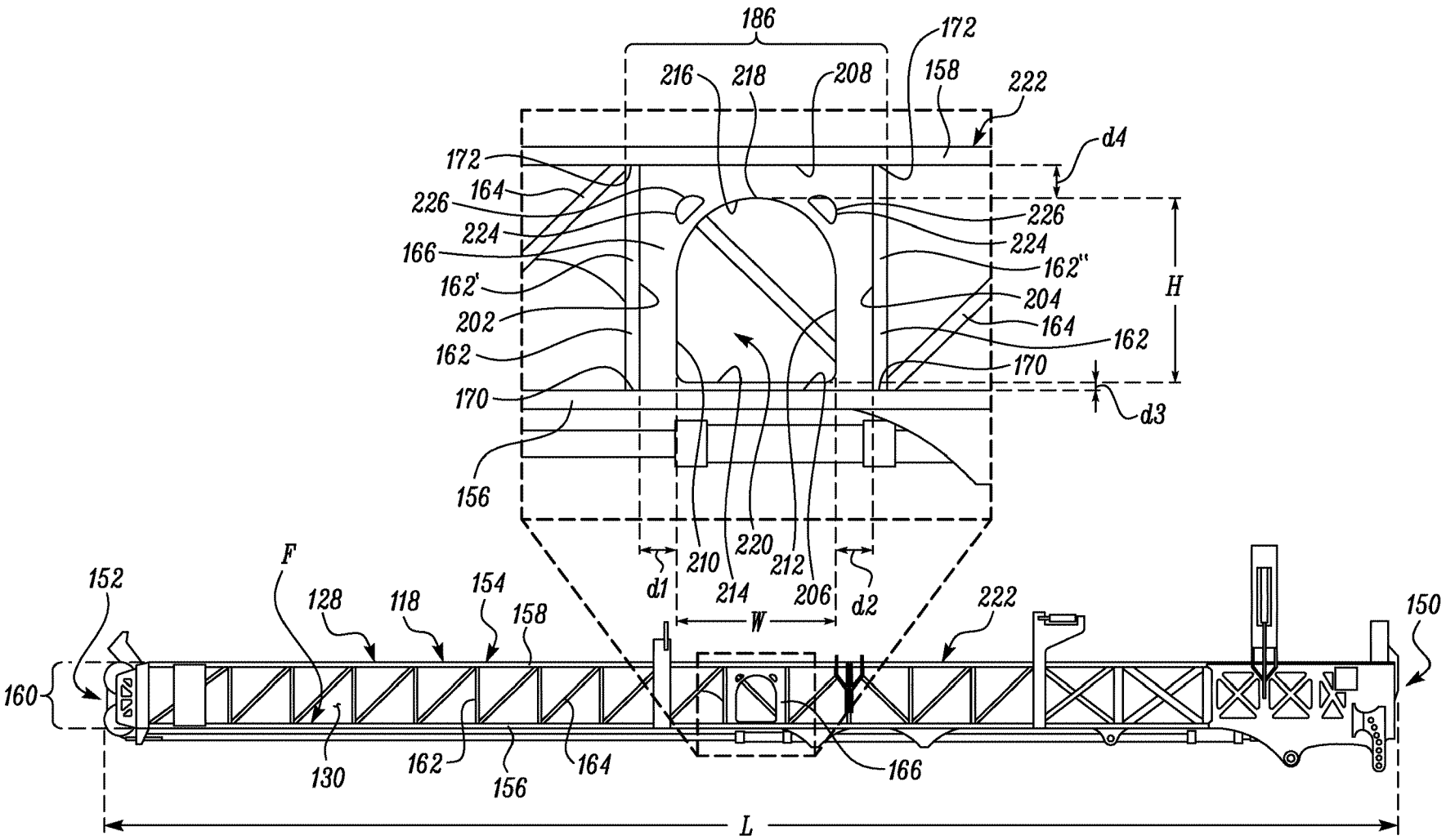
FIG. 4 is an enlarged view of the mast illustrating a portion of a side of the mast having an opening that facilitates access into the mast, in accordance with an embodiment of the present disclosure.

Referring to FIG. 4, details of the frame assembly 128 will now be discussed. The frame assembly 128 may include a first end 150 and a second end 152 located opposite to the first end 150. A length 'L' of the frame assembly 128 is defined between the first end 150 and the second end 152. In the lowered position of the frame assembly 128, the first end 150 may be proximal to the rearward end 106 and distal to the forward end 104, and the second end 152 may be proximal to the forward end 104 and distal to the rearward end 106. Further, the frame assembly 128 may include a left-hand side 154 and a right-hand side 154' (see FIG. 3), located transversely relative to the length 'L' of the frame assembly 128. The left-hand side 154 may be disposed towards the first lateral side 108 of the machine 100 and the right-hand side 154' may be disposed towards the second lateral side 108' of the machine 100, when viewed from the rearward end 106 of the machine 100.

The frame assembly 128 includes a first beam 156, a second beam 158, a plurality of links 162, a plurality of reinforcement members 164, and a plate 166. The first beam 156 and the second beam 158 may include (or be formed from) tubular elements or segments, or solid bars or beams. Although not limited, the first beam 156 and the second beam 158 may be substantially identical (e.g., in dimensions and/or shapes) to each other. The first beam 156 and the second beam 158 may include a cross-sectional shape, such as, but not limited to, a rectangular cross-sectional shape, a circular cross-sectional shape, an elliptical cross-sectional shape, an I-shaped cross-sectional shape, a C-shaped cross-sectional shape, a triangular cross-sectional shape, or a polygonal cross-sectional shape.

The first beam 156 and the second beam 158 may extend between the first end 150 and the second end 152, along the length 'L' of the frame assembly 128. The first beam 156 and the second beam 158 may be disposed spaced apart from one another—i.e., the first beam 156 may be disposed vertically below the second beam 158 in the lowered position of the frame assembly 128 such that the first beam 156 may be located relatively closer to the ground 124 than the second beam 158 (see FIG. 2), when the frame assembly 128 is in the lowered position.

The first beam 156 and the second beam 158 may collectively form a pair 160. In some examples, the frame assembly 128 may include an additional pair of beams (not shown) that is similar to the pair 160, such that the pair 160 and the additional pair may be disposed spaced apart from one another and may be located transversely relative to the length 'L' of the frame assembly 128. The pair 160 may be directed towards the first lateral side 108 of the machine 100 or towards the left-hand side 154 of the frame assembly 128, while the additional pair may be directed towards the second lateral side 108' of the machine 100 or towards the right-hand side of the frame assembly 128, when the frame assembly 128 is in the lowered position. In the illustrated embodiment, the pair 160 is directed towards the first lateral side 108 of the machine 100.

The plurality of links 162 may include tubular elements, or solid bars or beams. The links 162 may include a cross-sectional shape such as, but not limited to, a rectangular cross-sectional shape, a circular cross-sectional shape, an elliptical cross-sectional shape, an I-shaped cross-sectional shape, a C-shaped cross-sectional shape, a triangular cross-sectional shape, or a polygonal cross-sectional shape. As shown in FIG. 4, each link 162 includes a first end 170 and a second end 172. Each link 162 is fixedly connected to the first beam 156 at the first end 170 and is fixedly connected to the second beam 158 at the second end 172, thereby coupling the first beam 156 to the second beam 158. In the present embodiment, the link 162 is coupled to each of the first beam 156 and the second beam 158 by welding. In some embodiments, it may be contemplated that the links 162 are connected to the first beam 156 and the second beam 158 via other known fastening means, such as by use of nuts and bolts, or studs and yokes, rivets, and the like.

Further, the links 162 are sequentially arranged between the first beam 156 and the second beam 158. In that manner, the links 162 are spaced apart from each other along the length 'L' of the frame assembly 128. In an example, the links 162 may be sequentially and equidistantly arranged between the first beam 156 and the second beam 158. In another example, in which the frame assembly 128 may include two pairs 160, links (similar to the links 162) may be sequentially and equidistantly arranged between the two first beams 156 of the two pairs 160, respectively, (only one of which is visible in FIG. 4) to define a floor 'F' of the frame assembly 128. Although not limited, the links 162 are arranged substantially perpendicular with respect to the first beam 156 and the second beam 158. In some embodiments, it may be contemplated that the links 162 may be inclined at any suitable angle with respect to the first beam 156 and the second beam 158. Also, the links 162 may define equal lengths and may be parallely disposed with respect to one another along the length 'L'.

The reinforcement members 164 may be tubular elements (e.g., steel tubular elements), or solid bars or beams, which may have a circular, elliptical, triangular, square, polygonal, I-shaped, or any other type of cross-section known in the art. The reinforcement members 164 are correspondingly disposed and span between the successive links 162 (i.e., one reinforcement member 164 is disposed and spans between a preceding link 162 and a succeeding link 162). Further, the reinforcement members 164 may be disposed angularly with respect to the links 162 and to the first beam 156 and the second beam 158. In the present embodiment, each reinforcement member 164 is disposed angularly between the preceding link 162 and the succeeding link 162 such that each reinforcement member 164 may be coupled to the preceding link 162 at a location proximal to the first end 170 of the preceding link 162, and may be coupled to the succeeding link 162 at a location proximal to the second end 172 of the succeeding link 162, or vice versa, as shown in FIG. 4.

According to an aspect of the present disclosure, at least one pair 186 of the successive links 162 (i.e., one pair comprising the preceding link 162 and the succeeding link 162) may be devoid of the reinforcement member 164. More particularly, the pair 186 of the successive links 162 may include a first link 162' and a second link 162", and a reinforcement member 164 may be omitted from between the first link 162' and the second link 162".

The plate 166 is disposed between the first link 162' and the second link 162". The plate 166 may have a flat shape. The plate 166 may be a rectangularly shaped plate defined by four side edges—a first side edge 202, a second side edge 204, a third side edge 206, and a fourth side edge 208. In the present embodiment, all the four side edges of the plate 166, i.e., the first side edge 202, the second side edge 204, the third side edge 206, and the fourth side edge 208, may include a linear profile. The first side edge 202 and the second side edge 204 may be disposed spaced apart and substantially parallel to one another. Similarly, the third side edge 206 and the fourth side edge 208 may be disposed spaced apart and substantially parallel to one another. Also, the first side edge 202 and the second side edge 204 may be orthogonally oriented with respect to the third side edge 206 and the fourth side edge 208. In that manner, the first side edge 202 and the second side edge 204 may be oriented substantially parallel to the links 162 (or the first link 162' and the second link 162"), and substantially perpendicular to the first beam 156 and the second beam 158. In the same manner, the third side edge 206 and the fourth side edge 208 may be oriented substantially parallel to the first beam 156 and the second beam 158, and substantially perpendicular to the links 162 (or the first link 162' and the second link 162").

Referring to FIG. 4, the plate 166 may include four inner edges—a first inner edge 210, a second inner edge 212, a third inner edge 214, and a fourth inner edge 216, to form an opening 220 of the plate 166. In the present embodiment, three inner edges, i.e.,—the first inner edge 210, the second inner edge 212, the third inner edge 214, may include a linear profile, and one inner edge, i.e.,—the fourth inner edge 216 may include an arcuate profile, e.g., a semi-circular profile. The first inner edge 210 and the second inner edge 212 may be disposed spaced apart and substantially parallel to one another to define a width 'W' of the opening 220. In the present embodiment, the width 'W' of the opening 220 is at least 760 millimeters. For example, the width 'W' of the opening 220 is 775 millimeters.

Also, the first inner edge 210 and the second inner edge 212 may be disposed upright relative to the third inner edge 214. The fourth inner edge 216 may extend from the first inner edge 210 to the second inner edge 212 to uninterruptedly and contiguously connect the first inner edge 210 with the second inner edge 212. Also, the fourth inner edge 216 defines an apex 218 at a height 'H' with respect to the third inner edge 214. In the present embodiment, the height 'H' of the apex 218 with respect to the third inner edge 214 is at least 660 millimeters. For example, the height 'H' of the apex 218 is 908.3 millimeters. Further, the fourth inner edge 216 may be defined in such a manner that a concavity of a curvature defined by the fourth inner edge 216 may face and/or be directed towards (i.e., into) the opening 220.

The opening 220 may define an inverted U-shaped profile, when the frame assembly 128 is at the lowered position (see FIGS. 2 and 4). It is contemplated, however, that the opening 220 may have triangular, rectangular, square, rhomboidal, trapezoidal, or any other suitable shape known in the art such that the operator (or service personnel) may ingress or egress to and from the inner volume 130 of the mast 118. The opening 220 may be defined in a manner that—the first inner edge 210 may be disposed proximal to the first side edge 202; the second inner edge 212 may be disposed proximal to the second side edge 204; the third inner edge 214 may be disposed proximal to the third side edge 206; and the fourth inner edge 216 may be disposed proximal to the fourth side edge 208. Also, the opening 220 may be defined such that—a distance 'a' (measured in a direction defined along the third inner edge 214 or along the length 'L' of the mast 118) between the first inner edge 210 and the first side edge 202 may be equal to a distance 'd2' (measured in a direction defined along the third inner edge 214 or along the length 'L' of the mast 118) between the second inner edge 212 and the second side edge 204 (see FIG. 4). Furthermore, the opening 220 may be defined in a manner that—a distance 'd3' (measured in a direction defined along the first inner edge 210) between the third inner edge 214 and the third side edge 206 may be less than a distance 'd4' (measured in the direction defined along the first inner edge 210) between the apex 218 and the fourth side edge 208 (see FIG. 4).

The plate 166 is coupled to the first link 162' and the second link 162", and to the first beam 156 and the second beam 158. In the present embodiment, the first side edge 202 of the plate 166 may be coupled to the first link 162', and the second side edge 204 of the plate 166 may be coupled to the second link 162", respectively (see FIG. 4). In that manner, the first inner edge 210 may be disposed proximal to the first link 162' and distal to the second link 162", and the second inner edge 212 may be disposed proximal to the second link 162" and distal to the first link 162'. Also, in the present embodiment, the third side edge 206 may be coupled to the first beam 156, and the fourth side edge 208 may be coupled to the second beam 158. In that manner, the third inner edge 214 may be disposed proximal to the first beam 156 and distal to the second beam 158, and the fourth inner edge 216 may be disposed proximal to the second beam 158 and distal to the first beam 156. Further, in the present embodiment, the plate 166 may be coupled to the first link 162', the second link 162", the first beam 156, and the second beam 158, by welding. In this way, the plate 166, the first beam 156, the second beam 158, the links 162 (including the first link 162' and the second link 162"), and the reinforcement members 164, are welded together to combinedly form a truss 222.

In some embodiments, the plate 166 may possess a stiffness similar or equivalent to the stiffness of a reinforcement member 164 so as to impart strength to the truss 222, enabling the truss 222 to withstand various loads acting on the frame assembly 128. In some embodiments, the plate 166, the first beam 156, the second beam 158, the links 162 (including the first link 162' and the second link 162"), and the reinforcement members 164 may be an integrated structure (i.e., requiring no coupling with each other) fabricated via casting, additive manufacturing, etc.

The plate 166 may be disposed on the frame assembly 128 in a manner that the opening 220 may align with the platform 136 of the mast access assembly 134, when the frame assembly 128 is in the lowered position (see FIGS. 2 and 3). In this way, the opening 220 may facilitate the operator (or service personnel) to easily access into the inner volume 130 of the frame assembly 128, when the frame assembly 128 is in the lowered position. To further facilitate the operator (or service personnel) to safely enter and/or exit the inner volume 130, the plate 166 may be provided with one or more handles 224. According to one example, the handles 224 may be formed as cutouts 226 formed through the plate 166 (see FIG. 4) (only two cutouts 226 are provided on the plate 166, however, it may be envisioned that more or less numbers of such cutouts may be provided on the plate 166). The cutouts 226 may be disposed proximal to the fourth inner edge 216 and distal to the third inner edge 214. Also, the cutouts 226 may be formed at a region, of the plate 166, defined between the fourth inner edge 216 and the fourth side edge 208 so that an operator may use either or both the cutouts 226 to hold (e.g., firmly) onto the plate 166 and enter into the inner volume 130 through the opening 220 defined in the plate 166. In some embodiments, it is contemplated, however, that the cutouts 226 may be formed at any suitable region on the plate 166 to provide support to the operator (or service personnel) going in and out of the inner volume 130 of the mast 118.

The first beam 156, the second beam 158, the links 162, and the reinforcement members 164 may be made up of materials, such as steel. The plate 166 may be fabricated from a suitable material which may be compatible with or the same as the material from which the first beam 156, the second beam 158, the links 162, and the reinforcement members 164, are fabricated.

INDUSTRIAL APPLICABILITY

During a drilling operation, several components associated with the drilling assembly 120 (disposed within the inner volume 130 or attached to the frame assembly 128)

may be subjected to cyclic loading. As a result, such components may require regular servicing and maintenance—e.g., daily, weekly, or monthly. To perform the servicing and maintenance of such components, an operator (or service personnel), may enter the inner volume 130 of the mast 118 (e.g., at the end of a work cycle). In this regard, the mast 118 provides an opening 220 that facilitates the operator (or service personnel) to easily enter into the inner volume 130 of the mast 118, when the frame assembly 128 is in the lowered position.

During service or maintenance, an operator may move the frame assembly 128 from the raised position (see FIG. 1) to the lowered position (see FIG. 2) such that—the opening 220 aligns with the platform 136. According to one exemplary operator ingress scheme, once the frame assembly 128 attains the lowered position, the operator (or service personnel) may use the stairway 138 to reach up to the platform 136. Next, the operator (or service personnel) may move on the platform 136 to reach in proximity to the opening 220, may turn around to face away from the opening 220 towards the first lateral side 108, may sit on a portion of the floor 'F' of the mast 118 disposed adjacent to the opening 220 (or plate 166), may grasp the handles 224 (or cutouts 226), and may transit from the platform 136 into the inner volume 130 of the mast 118 through the opening 220. Once the operator (or service personnel) gains access into the inner volume 130 of the mast 118, the operator (or service personnel) may move (e.g., by walking or crawling) within the inner volume 130 to reach out to the one or more components of the drilling assembly 120 to perform any servicing or maintenance work. An operator egress scheme may be contemplated in reverse to the aforementioned operator ingress scheme.

By way of the opening 220 formed in the plate 166, an operator thus gains access into the inner volume 130 from a side of the mast 118, for example—from the left-hand side 154 of the frame assembly 128 of the mast 118, thus making the access into and out of the inner volume 130 (e.g., both ingress and egress) easy and safe. The above-discussed arrangement of the plate 166 with the opening 220 may be formed on the other side of the frame assembly 128 i.e., on the right-hand side 154' of the frame assembly 128, as well, such that the operator (or service personnel) may gain access from either side of the frame assembly 128.

It will be apparent to those skilled in the art that various modifications and variations can be made to the method/process of the present disclosure without departing from the scope of the disclosure. Other embodiments will be apparent to those skilled in the art from consideration of the specification and practice of the method/process disclosed herein. It is intended that the specification and examples be considered as exemplary only, with a true scope of the disclosure being indicated by the following claims and their equivalent.

What is claimed is:

1. A mast for a drilling machine, comprising:

a frame assembly defining an inner volume to accommodate a drilling assembly, the frame assembly configured to move between a lowered position and a raised position with respect to a chassis of the drilling machine, the frame assembly including:

a first beam and a second beam configured to be directed towards a lateral side of the drilling machine in the lowered position;

a plurality of links sequentially arranged between the first beam and the second beam coupling the first beam to the second beam;

a plurality of reinforcement members correspondingly disposed and spanning between successive links of the plurality of links with at least one pair of successive links of the plurality of links being devoid of a reinforcement member of the plurality of reinforcement members; and a plate disposed between the successive links of the at least one pair of successive links, the plate being coupled to each link of the at least one pair of successive links and to the first beam and the second beam, the plate defining an opening to facilitate access to the inner volume of the frame assembly, wherein the first beam, the second beam, the plurality of links, the plurality of reinforcement members, and the plate, combinedly form a truss, and wherein the plate defines a first inner edge, a second inner edge, a third inner edge, and a fourth inner edge to form the opening, the first inner edge and the second inner edge being disposed upright relative to the third inner edge, and the fourth inner edge extending.

2. The mast of claim 1, wherein the plate is coupled to each link of the at least one pair of successive links and to the first beam and the second beam by welding.

3. The mast of claim 1, wherein the fourth inner edge includes a semi-circular profile.

4. The mast of claim 1, wherein each of the first inner edge, the second inner edge, and the third inner edge, includes a linear profile.

5. The mast of claim 1, wherein the third inner edge is disposed proximal to the first beam and distal to the second beam, and the fourth inner edge is disposed proximal to the second beam and distal to the first beam.

6. The mast of claim 1, wherein the plate defines a first side edge and a second side edge, the first side edge being coupled to a first link of the at least one pair of successive links and the second side edge being coupled to a second link of the at least one pair of successive links, wherein a distance between the first inner edge and the first side edge when measured in a direction defined along the third inner edge is equal to a distance between the second inner edge and the second side edge when measured in the direction defined along the third inner edge.

7. The mast of claim 6, wherein the plate defines a third side edge and a fourth side edge, the third side edge being coupled to the first beam and the fourth side edge being coupled to the second beam, wherein the fourth inner edge defines an apex, and a distance between the third inner edge and the third side edge when measured in a direction defined along the first inner edge is less than a distance between the apex and the fourth side edge of the plate when measured in the direction defined along the first inner edge.

8. The mast of claim 7, wherein each of the first side edge, the second side edge, the third side edge, and the fourth side edge, includes a linear profile.

9. The mast of claim 1, wherein the plate includes one or more handles.

10. A drilling machine, comprising:

a chassis;

a drilling assembly;

a mast including a frame assembly defining an inner volume to accommodate the drilling assembly, the frame assembly configured to move between a lowered position and a raised position with respect to the chassis, the frame assembly including:

a first beam and a second beam configured to be directed towards a lateral side of the drilling machine in the lowered position;

a plurality of links sequentially arranged between the first beam and the second beam coupling the first beam to the second beam;

a plurality of reinforcement members correspondingly disposed and spanning between successive links of the plurality of links with at least one pair of successive links of the plurality of links being devoid of a reinforcement member of the plurality of reinforcement members; and a plate disposed between the successive links of the at least one pair of successive links, the plate being coupled to each link of the at least one pair of successive links and to the first beam and the second beam, the plate defining an opening to facilitate access to the inner volume of the frame assembly, wherein the first beam, the second beam, the plurality of links, the plurality of reinforcement members, and the plate, combinedly form a truss; and a platform, wherein the opening aligns with the platform in the lowered position of the frame assembly.

11. The drilling machine of claim 10, wherein the plate is coupled to each link of the at least one pair of successive links and to the first beam and the second beam by welding.

12. The drilling machine of claim 10, wherein the plate defines:

a first inner edge, a second inner edge, a third inner edge, and a fourth inner edge to form the opening, the first inner edge and the second inner edge being disposed upright relative to the third inner edge, and the fourth inner edge extending from the first inner edge to the second inner edge and defining an arcuate profile to impart an inverted U-shaped profile to the opening in the lowered position of the frame assembly.

13. The drilling machine of claim 12, wherein the fourth inner edge includes a semi-circular profile.

14. The drilling machine of claim 12, wherein each of the first inner edge, the second inner edge, and the third inner edge, includes a linear profile.

15. The drilling machine of claim 12, wherein the third inner edge is disposed proximal to the first beam and distal to the second beam, and the fourth inner edge is disposed proximal to the second beam and distal to the first beam.

16. The drilling machine of claim 12, wherein the plate defines a first side edge and a second side edge, the first side edge being coupled to a first link of the at least one pair of successive links and the second side edge being coupled to a second link of the at least one pair of successive links, wherein a distance between the first inner edge and the first side edge when measured in a direction defined along the third inner edge is equal to a distance between the second inner edge and the second side edge when measured in the direction defined along the third inner edge.

17. The drilling machine of claim 16, wherein the plate defines a third side edge and a fourth side edge, the third side edge being coupled to the first beam and the fourth side edge being coupled to the second beam, wherein the fourth inner edge defines an apex, and a distance between the third inner edge and the third side edge when measured in a direction defined along the first inner edge is less than a distance between the apex and the fourth side edge of the plate when measured in the direction defined along the first inner edge.

18. The drilling machine of claim 17, wherein each of the first side edge, the second side edge, the third side edge, and the fourth side edge, includes a linear profile.

* * * * *